US006508093B2

(12) United States Patent
Berthelet et al.

(10) Patent No.: US 6,508,093 B2
(45) Date of Patent: Jan. 21, 2003

(54) METHOD AND APPARATUS FOR ULTRASONIC PEENING OF ANNULAR RECESSES FOR THE ATTACHMENT OF BLADES TO A ROTOR

(75) Inventors: Benoît Jean Henri Berthelet, Maisons Alfort (FR); Francis Lucien Guy Chareyre, Franconville (FR); Willy Lionel Fradin, Vaux sur Vienne (FR); Hakim Hoffmann, Naintre (FR); Stéphane Michel Kerneis, Velizy (FR); Marie-Christine Marcelle Ntsama-Etoundi, Charenton le Pont (FR); Guillaume François Roger Simon, Montigny le Bretonneux (FR)

(73) Assignee: Snecma Moteurs and Snecma Services, Paris (FR)

( * ) Notice: Subject to any disclaimer, the term of this patent is extended or adjusted under 35 U.S.C. 154(b) by 0 days.

(21) Appl. No.: 09/987,857

(22) Filed: Nov. 16, 2001

(65) Prior Publication Data

US 2002/0069687 A1 Jun. 13, 2002

(30) Foreign Application Priority Data

Nov. 16, 2000 (FR) ..... 00 14769

(51) Int. Cl.[7] ..... B24C 1/00; B05D 3/12; C21D 7/00

(52) U.S. Cl. ..... 72/53; 29/90.7; 219/121.68

(58) Field of Search ..... 72/53; 29/90.7; 219/121.68

(56) References Cited

U.S. PATENT DOCUMENTS

| | | | | | |
|---|---|---|---|---|---|
| 2,460,657 | A | * | 2/1949 | Robinson | 72/53 |
| 3,482,423 | A | * | 12/1969 | Murry | 72/53 |
| 3,668,913 | A | * | 6/1972 | Morris | 72/53 |
| 3,675,452 | A | * | 7/1972 | Osmolovsky et al. | 72/53 |
| 4,419,875 | A | * | 12/1983 | DeClark et al. | 72/53 |
| 4,426,867 | A | | 1/1984 | Neal et al. | |
| 5,499,519 | A | * | 3/1996 | Brunier et al. | 72/53 |
| 5,509,286 | A | * | 4/1996 | Coulon | 72/53 |
| 5,620,307 | A | * | 4/1997 | Mannava et al. | 219/121.68 |
| 5,671,628 | A | * | 9/1997 | Halila et al. | 29/90.7 |
| 5,829,116 | A | * | 11/1998 | Vilon | 72/53 |
| 5,846,057 | A | * | 12/1998 | Ferrigno et al. | 219/121.6 |
| 5,948,293 | A | * | 9/1999 | Somers et al. | 72/53 |
| 5,950,470 | A | * | 9/1999 | Prewo et al. | 72/53 |
| 6,170,308 | B1 | * | 1/2001 | Veronesi et al. | 29/90.7 |
| 6,289,705 | B1 | | 9/2001 | Duquenne et al. | |
| 6,336,844 | B1 | | 1/2002 | Duquenne et al. | |
| 6,340,500 | B1 | * | 1/2002 | Spitsberg | 72/53 |
| 6,343,495 | B1 | * | 2/2002 | Cheppe et al. | 72/53 |

FOREIGN PATENT DOCUMENTS

| | | |
|---|---|---|
| EP | 1 101 568 | 5/2001 |
| FR | 2 689 431 | 10/1993 |
| FR | 2 714 629 | 7/1995 |

* cited by examiner

*Primary Examiner*—David Jones
(74) *Attorney, Agent, or Firm*—Oblon, Spivak, McClelland, Maier & Neustadt, P.C.

(57) ABSTRACT

The invention relates to a method for the ultrasonic peening of annular recesses for the attachment of blades to a rotor rim, these recesses including a blade introduction opening. According to the method, a plurality of beads is placed on a vibratory surface of a sonotrode, arranged in an intermediate position in a sleeve having opposed closing-off means capable of sliding in the recess, the introduction opening is placed facing the sonotrode, the sonotrode and the sleeve are moved together toward the introduction opening into a peening position in which the closing-off means face the recess ends opening into said opening, then the rotor rim is turned about its axis so as to bring the closing-off means into a first end of the recess so as to form a closed chamber containing the beads. The rim is turned and the vibratory surface is vibrated to mobilize the beads within the chamber, thereby peening the recess.

14 Claims, 5 Drawing Sheets

METHOD AND APPARATUS FOR ULTRASONIC PEENING OF ANNULAR RECESSES FOR THE ATTACHMENT OF BLADES TO A ROTOR

BACKGROUND OF THE INVENTION

1. Field of the Invention

The invention relates to a method of surface treating and compressively prestressing by peening the wall of at least one annular recess approximately in the shape of a dovetail, formed at the periphery of a rotor rim, said annular recess opening to the outside via an annular lateral mouth and having at least two recess ends opening into, respectively, at least one blade introduction opening.

In particular, it is necessary to compressively prestress the wall of an annular recess for hammered attachment of the blades to a turbomachine rotor capable of containing blade roots, the lines of contact between the annular recess and each blade root are highly stressed. What happens in operation is that the turbine or fan blades immobilized in an annular recess by various means, are subjected to considerable centrifugal forces leading to significant frictional wear at these lines of contact. This frictional wear reduces the life of the parts in operation and leads to them having to be changed regularly.

2. Summary of the Prior Art

In order to improve the fatigue strength of the turbine rotor and to harden the surface of the annular recesses in the region of the lines of contact, it is known practice for the annular recesses to be peened using beads ejected from a compressed air nozzle introduced into each recess. The beads cause permanent compression of the treated surface over a shallow thickness so as to oppose the onset and propagation of cracks at the surface of the part.

These nozzles are able to project only microbeads of a diameter smaller than 1 mm, and typically of between 0.3 mm and 0.5 mm. Furthermore, the distribution of the beads, both in terms of position and in terms of speed, follows a Gaussian distribution.

This method is necessarily lengthy because the entire surface area of the cavity is treated only by a succession of local treatments which may, furthermore, introduce unwanted local deformation and cause the incrustation of bead residue.

In addition, the peening performed is light in order not to generate excessive roughness in the region of the treated zone, and this leads to a limited hardening of the surface. The problem is that since the diameter of the projected beads is small, the more intense the peening, the greater the damage caused to the surface finish.

Finally, the method, which involves numerous parameters, is difficult to control and difficult to reproduce.

SUMMARY OF THE INVENTION

The object of the invention is to propose a method for peening the annular recesses of turbine rotors, which makes it possible to create reproducible prestresses in all the recesses, in a relatively short period of time, while at the same time allowing relatively intense peening, that is to say a greater depth of compression at the surface. This is to be achieved without the introduction of deformation, while at the same time limiting the damage caused to the treated surface.

According to the invention, there is provided a method of surface treating and compressively prestressing by peening a wall of at least one annular recess approximately in the shape of a dovetail, formed in the periphery of a rotor rim, said annular recess opening to the outside via an annular lateral mouth and having at least two recess ends opening into, respectively, at least one blade introduction opening, said method comprising the steps of:

a) providing a sonotrode arranged within a sleeve, said sonotrode having a vibratory surface and ultrasonic means for vibrating said vibratory surface, and said sleeve having opposed closing-off means capable of sliding in the recess;

b) placing a plurality of beads of a predetermined diameter on said vibratory surface of said sonotrode with said sonotrode arranged in an intermediate position in which said sleeve surrounds said vibratory surface;

c) placing said introduction opening facing said sonotrode;

d) moving said sonotrode together with said sleeve substantially vertically toward said blade introduction opening to place them in a peening position in which said closing-off means face said recess ends that open into said opening;

e) turning said rotor rim about an axis of rotation arranged horizontally in such a way as to bring said closing-off means into a first recess end so as to form a closed moving chamber containing said beads; and f) operating said ultrasonic means to vibrate said vibratory surface of said sonotrode whereby said beads are mobilized in said moving chamber, and, by uniformly turning said rotor rim about said axis of rotation until said second recess is reached, ultrasonically peening the entirety of said wall of said recess.

The method makes it possible to obtain a uniform distribution of the beads within the chamber. As the beads travel in random directions, they strike the walls of the cavities at varying angles, and this improves the surface finish by comparison with beads projected by a nozzle in one predominant direction.

The method requires only a small quantity of beads. It is therefore possible to use beads which are of high quality in terms of hardness and in terms of geometry, for example steel or ceramic ballbearings, which allows the surface finish to be better preserved.

According to a preferred embodiment of the invention, the method further includes the step of moving said sonotrode substantially vertically so that said vibratory surface is level with said lateral mouth of said recess, after the step of moving said sonotrode and said sleeve together into said peening position.

As the volume in which the plurality of beads is distributed is smaller than the volume obtained when the vibratory surface remains outside the mouth, the method requires a shorter peening treatment time.

According to another preferred embodiment, the peening step is conducted at least three successive times on said wall by reversing the direction of rotation of said rotor rim each time one of said recess ends is neared.

Not all of the wall of the annular recess is subjected to the impact of the beads at the same time, and this leads to risks that the cavity, particularly the recess containing the blade root, will become deformed, given the magnitude of the diameter of the rim with respect to its thickness. The fact that the wall is treated in three successive treatments allows rim deformation to be compensated for considerably.

Of course, it is also possible to carry out three successive peening operations keeping the same direction of rotation of the rotor rim and halting peening when the closing-off cheeks and the vibratory surface near a first mouth end, then reactivating the plurality of beads when the closing-off cheeks and the vibratory surface are out of the introduction opening again introduced into the mouth.

According to yet another preferred embodiment, the method includes the step of placing a deflector in said moving chamber.

The deflector may be of approximately triangular geometry with sides parallel to the divergent wall portions so as to reduce the effect of the peening of the zone situated between said deflector and the bottom of the cavity.

According to an even yet further preferred embodiment, the method further includes the steps of rotating said rotor part about said axis of rotation so as to bring said closing-off means into said blade introduction opening after peening said first recess;

moving said sonotrode and said sleeve substantially vertically toward a lowered position;

moving said sleeve and said sonotrode together substantially horizontally toward an introduction opening of a second annular recess;

bringing said opening up to face said sonotrode; and positioning said sonotrode, supporting said beads, and said sleeve in said raised peening position to peen said second annular recess.

At the end of the treatment, the sonotrode is advantageously moved approximately vertically toward a lowered position in the sleeve, in which position the plurality of beads can be driven from the vibratory surface toward a reservoir through slots formed in the sleeve, after the annular recesses formed on the rotor rim have been peened.

Thus, the beads can easily be recovered so that they can either be reused in a subsequent treatment or be replaced.

According to another yet further preferred embodiment, the predetermined diameter of said beads exceeds 0.8 mm.

The beads used in the method according to the invention have a larger diameter than the diameter of the beads that can be projected by a nozzle, which means that the peening can be more intense while at the same time causing less substantial damage to the surface.

The invention also provides an apparatus for implementing the method, said apparatus comprising a sonotrode mounted in a sleeve equipped with closing-off means, said sonotrode being capable of projecting beads of a predetermined diameter into a moving chamber delimited by a wall portion of said annular recess, said vibratory surface of said sonotrode arranged near said mouth of recess, and said closing off means;

means for producing ultrasonic oscillations capable of exciting said sonotrode;

first means for moving said sonotrode substantially vertically; and second means for moving said closing-off means substantially vertically;

a first clearance, smaller than said diameter of said beads, being formed between said sonotrode and said sleeve; and a second clearance, smaller than said diameter of said beads, being formed between said closing-off means arranged in said annular recess and said annular recess.

The apparatus may comprise a number of acoustic assemblies each comprising a sonotrode and a sleeve, arranged around the rotor rim, said acoustic assemblies being capable of moving in an axial direction of the rotor rim.

According to a preferred embodiment, there is provided a third clearance, smaller than said diameter of said beads, formed between the mouth and said vibratory surface arranged in said mouth.

According to a further preferred embodiment, there is provided a fourth clearance, smaller than said diameter of said beads, formed between an end of said sleeve and said mouth which, when the vibratory surface is not closing off the mouth, ensures the chamber is sealed correctly.

The various elements of the apparatus are arranged in such a way that no bead can jam the elements that are capable of moving. Furthermore, the sonotrode and the sleeve comprising the closing-off means have a geometry tailored to the shape of the cavity to be treated. In particular, the vibratory surface is of a shape that complements the mouth, and the closing-off means are formed in such a way as to seal the chamber correctly.

According to a yet further preferred embodiment, said second means for moving said closing-off means are capable of moving said closing-off means and said sonotrode at the same time.

According to an even yet further preferred embodiment, said first means for moving said sonotrode and said second means for moving said closing-off means can advantageously be operated simultaneously.

At the beginning of the treatment, the sleeve and the sonotrode are placed in an intermediate position in which the space generated by the closing-off means of said sleeve and the vibratory surface of said sonotrode constitutes a reservoir for the beads. Next, said sleeve and said sonotrode supporting the beads are moved jointly with the same movement. Finally, the sonotrode and/or the closing-off means can be moved individually, depending on the geometry of the cavity to be treated, until, respectively, the vibratory surface closes off the mouth of the cavity and the closing-off means close off the openings of the cavity.

According to yet another preferred embodiment, said apparatus further comprises support means for supporting said rotor rim that is to be treated and means for driving said support means to cause said annular recess to rotate uniformly.

The apparatus advantageously comprises means for driving the beads from the vibratory surface toward a reservoir. These simple means make it possible to drive the beads toward the reservoir during a treatment if necessary, or at the end thereof, either to refresh the beads or to replace them.

Advantageously, the apparatus further comprises means for moving said sonotrode and said sleeve substantially horizontally.

A number of annular recesses, arranged on a rotor rim and having the same cross-section may thus be treated with one and the same apparatus which is movable in such a way as to position the sonotrode and the sleeve to face the recess in question.

DESCRIPTION OF THE PREFERRED EMBODIMENTS

Figure 1:
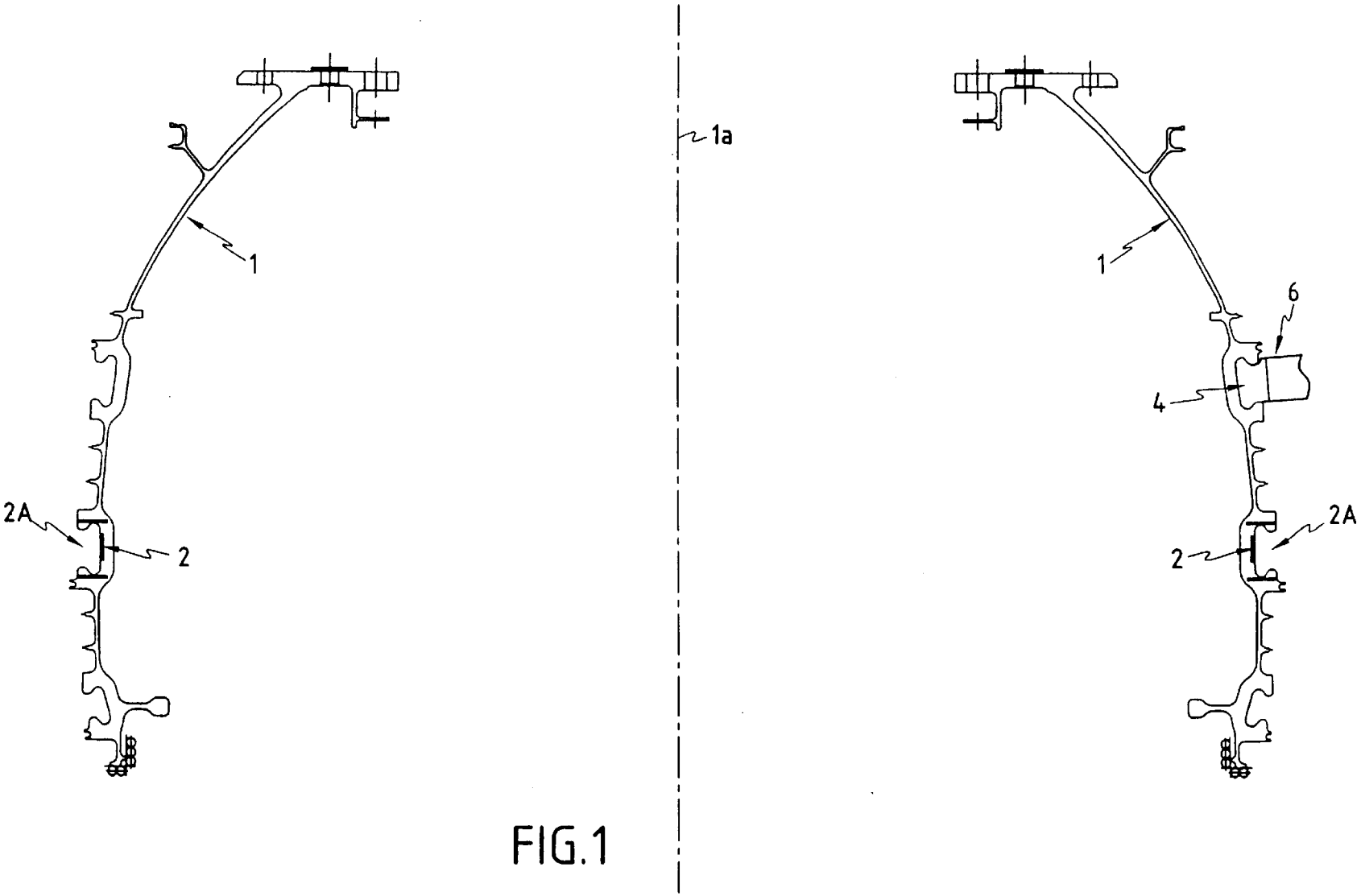
FIG. 1 is a front perspective view of a rotor rim having annular cavities formed in the periphery of the rotor rim.

FIG. 1 shows a rotor rim 1 comprising three annular recesses 2 formed in the periphery of the rotor rim 1 and distributed over different diameters of said rotor rim 1. These annular recesses 2 are approximately in the shape of dovetails and have a mouth 2A of approximately annular shape.

Figure 3:
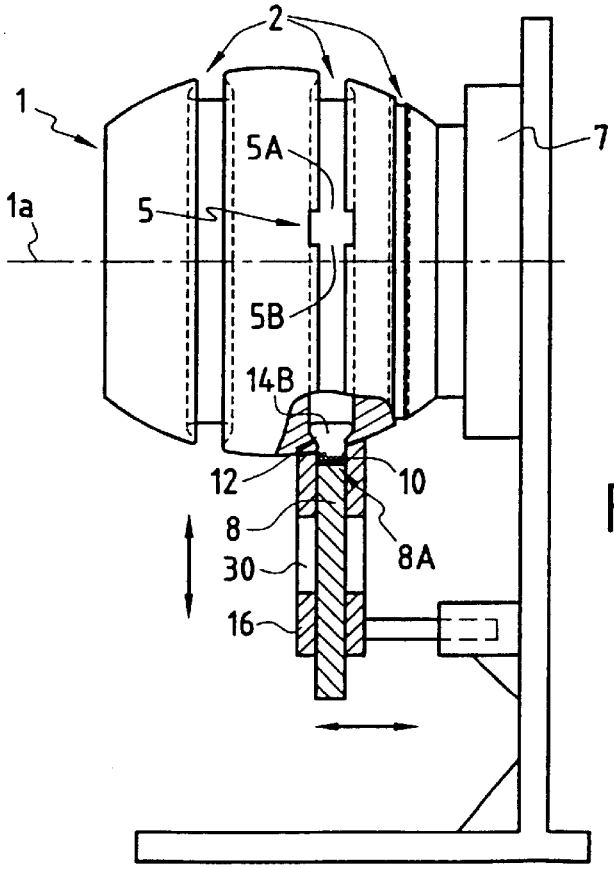
FIG. 3 is an axial section of an apparatus for carrying out the invention, a sleeve and a sonotrode being placed in an intermediate position.

In order to allow the fitting of the roots 4, approximately in the shape of dovetails, of the fan blades 6 in the recess 2, said recess 2 has a blade introduction opening 5 visible in FIG. 3.

Each blade root 4 is mounted in turn by sliding in the introduction opening 5. One or more blade fixing devices (not depicted) allow the blade 6 to be immobilized.

Figure 2:
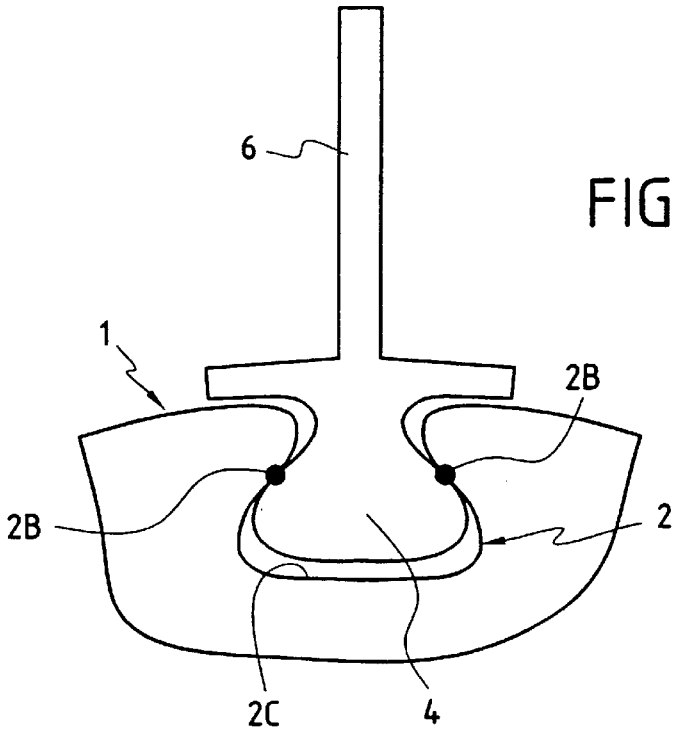
FIG. 2 is a front view of a fan blade arranged in an annular cavity of FIG. 1.

FIG. 2 shows that the walls of the recess 2 and the blade root 4 rest on one another along two lines of contact 2B.

The object of the invention is to propose a method and an installation for compressively prestressing a wall 2C of each recess 2 and, in particular, the regions of the two lines of contact 2B, so as to increase the resistance to wear of these lines of contact 2B, the wear being brought about by friction between the blade root 4 and the wall of the recess 2, and thus improve the fatigue strength of the rotor rim 1.

FIG. 3 shows an example of an apparatus used for implementing the method and in which just one acoustic assembly is used, said acoustic assembly, positioned below the rotor rim 1, being able to be moved vertically and horizontally.

The rotor rim 1 is held by a chuck 7 which can drive said rotor rim 1 in rotation about its axis of rotation 1A, arranged horizontally.

A sonotrode 8, a vibratory surface 8A of which is placed in an intermediate position in a sleeve 16, is mounted so that it can move under the rotor rim 1. A plurality of beads is placed on the vibratory surface 8A. An acoustic assembly comprising the sonotrode 8 and the sleeve 16 is moved horizontally until the vibratory surface 8A of the sonotrode 8 is facing the recess 2 to be treated.

The rotor rim 1 is turned about its axis 1A so as to place the introduction opening 5 facing the vibratory surface 8A.

Next, the sonotrode 8 and the sleeve 16 are moved vertically toward their raised peening position and the rotor rim is turned to bring the vibratory surface 8A near to a first recess end 5A, for example, so that closing-off cheeks 14A and 14B formed on the sleeve 16 position themselves in the recess 2 in such a way as to form a closed moving chamber 12.

Figure 4:
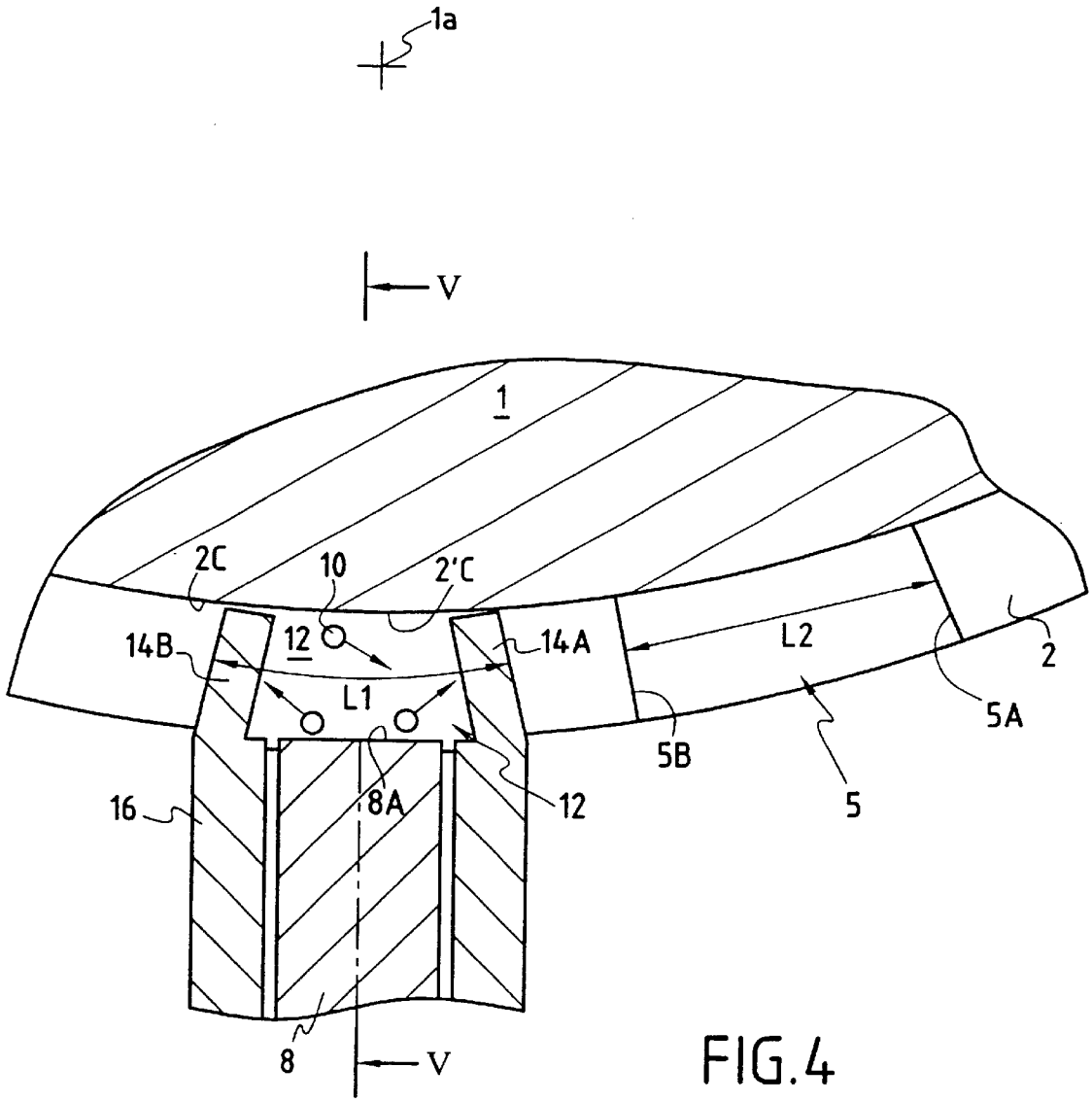
FIG. 4 is a section through the apparatus on a mid-plane perpendicular to the axis of rotation of the rotor rim, the sleeve and the sonotrode being placed in a raised peening position.

As indicated in FIG. 4, said moving chamber 12 is delimited by a wall portion 2'C, the vibratory surface 8A which closes off the mouth portion 2A, the closing-off cheeks 14A and 14B, and the sleeve 16.

A separation L1 between the two closing-off cheeks 14A and 14B is approximately equal to the circumferential extent L2 of the introduction opening 5.

Beads 10 of a diameter of between 0.8 mm and 5 mm, preferably equal to 1 mm, are projected by the upwardly-oriented vibratory surface 8A of the sonotrode 8, into the chamber 12.

Figure 5:
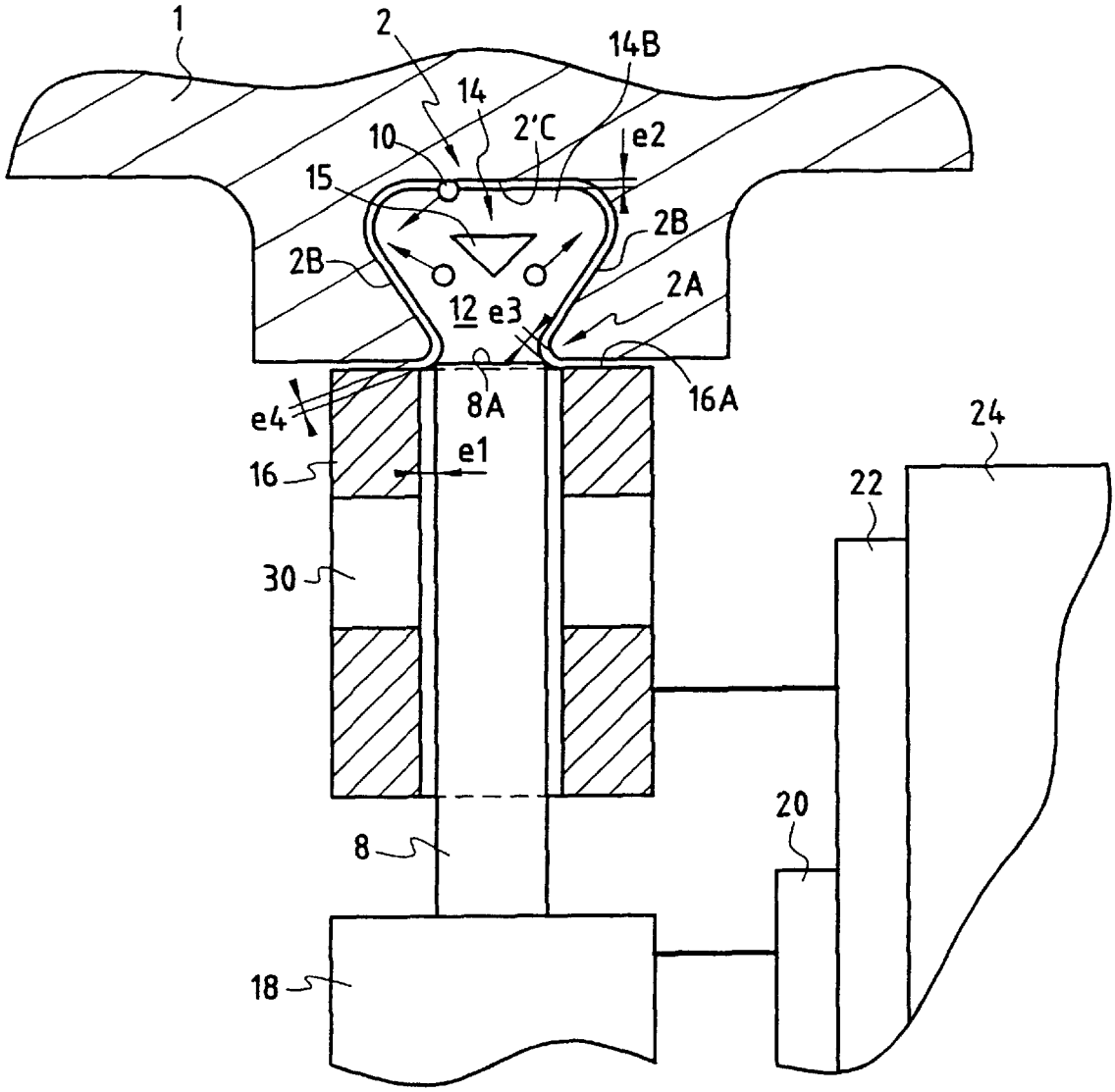
FIG. 5 is a section of FIG. 4 on V—V.

FIG. 5 shows that the vibratory surface 8A is excited by a vibration generator 18, for example a quartz generator, so as to mobilize the plurality of beads 10 in a chamber 12. A deflector 15 which is borne by the closing-off cheeks 14A and 14B may be placed in the recess so as to lessen the effect of the peening of the bottom of the recess and increase the peening of internal flanks of the mouth 21. Said deflector 15 is triangular with sides approximately parallel to the wall portions 2' C and to the bottom of the recess.

A clearance e1 formed between the sonotrode 8 and the sleeve 16 is smaller than the diameter of the beads 10, which means that no bead 10 can slip between the vibratory surface 8A and said sleeve 16.

The closing-off cheeks 14A and 14B in the shape of dovetails have axial cross sections that more or less complement those of the recess 2, so that, in the raised peening position, a clearance e2 formed between each closing-off cheek 14A, 14B and the wall portion 2'C that is to be peened is smaller than the diameter of the beads 10. Thus, no bead 10 can escape from the chamber 12.

Likewise, when the vibratory surface 8A closes off the mouth 2A in the raised peening position, a third clearance e3, formed between the vibratory surface 8A of the sonotrode 8 and the mouth 2A is smaller than the diameter of the beads 10 so that no bead 10 can leave the chamber 12. If the vibratory surface 8A does not close off the mouth, a fourth clearance e4 lying between an end 16A of the sleeve 16 and the mouth 2A ensures that the chamber 12 is sealed.

A first slide 20 allows the sonotrode 8 to be moved vertically by causing said sonotrode 8 to slide in the sleeve 16. A second slide 22, borne by a support structure 24, itself allows the sonotrode 8 and the sleeve 16 both to move vertically. Operating means (not depicted) allow said first slide 20 and said second slide 22 to be operated. Means (not depicted), for example rails, allow the acoustic assembly comprising the sonotrode 8 and the sleeve 16 to be moved horizontally, so as to position it facing a recess that is to be treated.

The first slide 20 may be borne either by the second slide 22, as shown in FIG. 5, or by the support structure 24, in which case the two slides 20 and 22 need to be operated synchronously in order to raise the sonotrode 8 and the sleeve 16 together toward the raised peening position.

Figure 6:
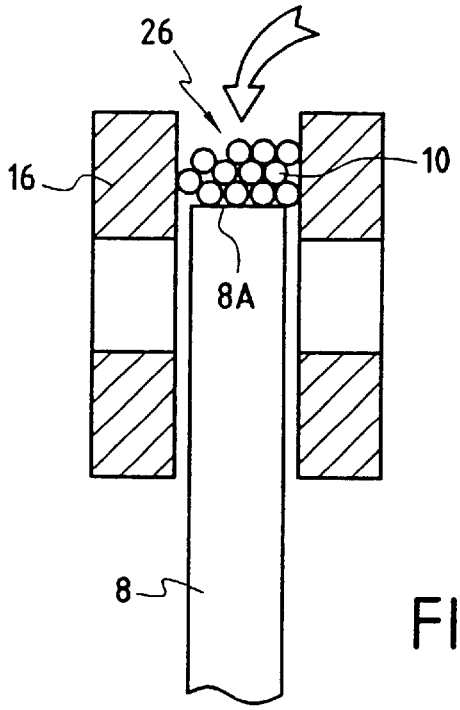
FIG. 6 is a section through the sleeve containing the sonotrode, in their intermediate position with a plurality of bends on a vibratory surface of the sonotrode.

Before beginning the operation of treating an axial recess 2, the sonotrode 8 is placed in an intermediate position in the sleeve 16, in which position the space delimited by the sleeve 16 and the vibratory surface 8A constitutes a receptacle 26 able to contain the plurality of beads 10 deposited on the vibratory surface 8A, as depicted in FIG. 6.

Having fixed the rotor rim 1 by holding means comprising a chuck 7, the sonotrode 8 and the sleeve 16 are moved close to a first recess 2 to be treated, and the introduction opening 5 of said first recess 2 is brought to face the sonotrode 8 by rotating the rotor rim 1 about its axis of rotation 1A using drive means (not depicted). The drive means comprise, for example, a motor.

The sonotrode 8 and the sleeve 16 are moved toward their raised peening position by simultaneously moving the closing-off cheeks 14A and 14B, and the vibratory surface 8A into the introduction opening 5, using the slide 22. The rotor rim 1 is then turned until the two cheeks 14A and 14B are in the end 5A. From that moment, peening of the wall portion 2'C of the first recess 2 can be performed by actuating the vibration generator 18 which mobilizes the plurality of beads 10 in the sealed moving chamber 12 and the rotor rim 1 is turned uniformly about its axis of rotation 1A so as to peen the entirety of the wall 2C.

When the first cheek 14A nears the end 5B of the mouth 2A, the direction of rotation of the rotor rim 1 is reversed and the wall portion 2'C continues to be peened as far as the other end 5A of the mouth 2A. The process is repeated once more until the end 5B is reached again. Of course, the method may involve more than three peening passes like the aforementioned.

As soon as the peening of the first recess 2 is over, the rotor rim 1 is turned so that the closing-off cheeks 14A, 14B position themselves in a blade introduction opening 5, the sonotrode 8 and the closing-off cheeks 14A and 14B are extricated from the introduction opening 5, then the acoustic assembly comprising the sonotrode 8 and the sleeve are moved horizontally to face a second recess 2, and treatment is resumed according to the aforementioned method and so on until all of the axial recesses 2 formed on the rotor rim 1 have been treated.

Figure 7:
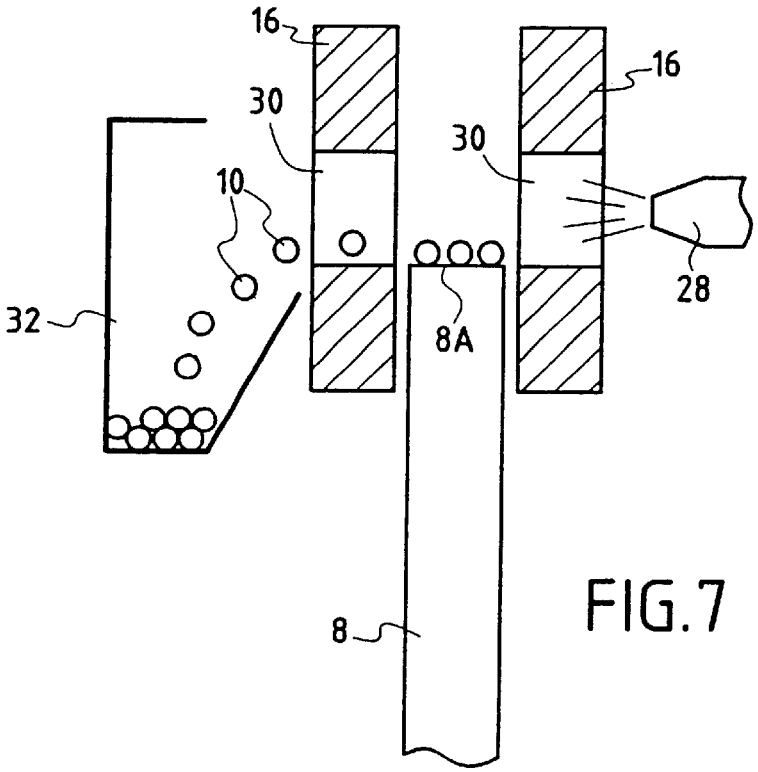
FIG. 7 is a section through the sleeve containing the sonotrode in its lowered position, showing a reservoir for the beads, and driving means for driving the beads into said reservoir.

At the end of the treatment, the sonotrode 8 is withdrawn to its lower position depicted in FIG. 7, in which the plurality of beads 10 is extricated. The beads 10 are, for example, blown from the surface 8A using a fan 28 through slots 30 formed in the sleeve 16 and recovered in a reservoir 32. Said beads 10 can then be refreshed or alternatively replaced with a view to a later treatment.

We claim:

1. A method of surface treating and compressively prestressing by peening a wall of at least one annular recess approximately in the shape of a dovetail, formed in the periphery of a rotor rim, said annular recess opening to the outside via an annular lateral mouth and having at least two recess ends opening into, respectively, at least one blade introduction opening, said method comprising the steps of:

a) providing a sonotrode arranged within a sleeve, said sonotrode having a vibratory surface and ultrasonic means for vibrating said vibratory surface, and said sleeve having opposed closing-off means capable of sliding in the recess;

b) placing a plurality of beads of a predetermined diameter on said vibratory surface of said sonotrode with said sonotrode arranged in an intermediate position in which said sleeve surrounds said vibratory surface;

c) placing said introduction opening facing said sonotrode;

d) moving said sonotrode together with said sleeve substantially vertically toward said blade introduction opening to place them in a peening position in which said closing-off means face said recess ends that open into said opening;

(e) turning said rotor rim about an axis of rotation arranged horizontally in such a way as to bring said closing-off means into a first recess end so as to form a closed moving chamber containing said beads; and f) operating said ultrasonic means to vibrate said vibratory surface of said sonotrode whereby said beads are mobilized in said moving chamber, and, by uniformly turning said rotor rim about said axis of rotation until said second recess is reached, ultrasonically peening the entirety of said wall of said recess.

2. A method according to claim 1, including the step of moving said sonotrode substantially vertically so that said vibratory surface is level with said lateral mouth of said recess, after the step of moving said sonotrode and said sleeve together into said peening position.

3. A method according to claim 1, wherein said peening step is conducted at least three successive times on said wall by reversing the direction of rotation of said rotor rim each time one of said recess ends is neared.

4. A method according to claim 1, including the step of placing a deflector in said moving chamber.

5. A method according to claim 1, further including the steps of:

rotating said rotor part about said axis of rotation so as to bring said closing-off means into said blade introduction opening after peening said first recess;

moving said sonotrode and said sleeve substantially vertically toward a lowered position;

moving said sleeve and said sonotrode together substantially horizontally toward an introduction opening of a second annular recess;

bringing said opening up to face said sonotrode; and positioning said sonotrode, supporting said beads, and said sleeve in said raised peening position to peen said second annular recess.

6. A method according to claim 1, wherein said predetermined diameter of said beads exceeds 0.8 mm.

7. An apparatus for use in carrying out the method according to claim 1, comprising a sonotrode mounted in a sleeve equipped with closing-off means, said sonotrode being capable of projecting beads of a predetermined diameter into a moving chamber delimited by a wall portion of said annular recess, said vibratory surface of said sonotrode, arranged near said mouth of said recess, and said closing-off means;

means for producing ultrasonic oscillations capable of exciting said sonotrode;

first means for moving said sonotrode substantially vertically; and second means for moving said closing-off means substantially vertically;

a first clearance, smaller than said diameter of said beads, being formed between said sonotrode and said sleeve; and a second clearance, smaller than said diameter of said beads, being formed between said closing-off means arranged in said annular recess and said annular recess.

8. An apparatus according to claim 7, wherein a third clearance, smaller than said diameter of said beads, is formed between said mouth of said recess and said vibratory surface arranged in said mouth.

9. An apparatus according to claim 8, wherein a fourth clearance, smaller than said diameter of said beads, is formed between an end of said sleeve and said mouth.

10. An apparatus according to claim 7, wherein said second means for moving said closing-off means are capable of moving said closing-off means and said sonotrode at the same time.

11. An apparatus according to claim 7, wherein said first means for moving said sonotrode and said second means for moving said closing-off means can be operated simultaneously.

12. An apparatus according to claim 7, which further comprises support means for supporting said rotor rim that is to be treated, and means for driving said support means to cause said annular recess to rotate uniformly.

13. An apparatus according to claim 7, which further comprises means for driving said plurality of beads from said vibratory surface toward a reservoir.

14. An apparatus according to claim 7, which further comprises means for moving said sonotrode and said sleeve substantially horizontally.

* * * * *